US006832691B2

(12) United States Patent
Miles et al.

(10) Patent No.: US 6,832,691 B2
(45) Date of Patent: Dec. 21, 2004

(54) MAGNETIC SEPARATION SYSTEM AND METHOD FOR SEPARATING

(75) Inventors: David Roger Miles, Kelowna (CA); Peter T. Watson, Kelowna (CA); A. Bruce Paige, Kelowna (CA)

(73) Assignee: Rampage Ventures Inc., George Town (KY)

( * ) Notice: Subject to any disclaimer, the term of this patent is extended or adjusted under 35 U.S.C. 154(b) by 0 days.

(21) Appl. No.: 10/125,386

(22) Filed: Apr. 19, 2002

(65) Prior Publication Data

US 2003/0196935 A1 Oct. 23, 2003

(51) Int. Cl.[7] ..... B03C 1/00
(52) U.S. Cl. ..... 209/232.2; 209/231
(58) Field of Search ..... 209/213, 24, 223.1, 209/223.2, 225, 226, 227, 228, 229, 230, 231, 243, 246, 247, 636

(56) References Cited

U.S. PATENT DOCUMENTS 463,305 A * 11/1891 Hoffman ..... 209/226
500,604 A * 7/1893 Payne ..... 209/214
500,605 A * 7/1893 Payne ..... 209/219
1,000,392 A * 8/1911 Feeley ..... 209/223.2
1,459,147 A * 6/1923 Dings ..... 209/223.2
2,315,712 A * 4/1943 Jacobson ..... 209/228
2,332,701 A 10/1943 Dowsett
3,327,852 A * 6/1967 Mortsell ..... 209/219
3,856,666 A * 12/1974 Yashima et al. ..... 209/219
4,463,844 A * 8/1984 Huffman et al. ..... 194/213
4,849,099 A * 7/1989 Knoll et al. ..... 209/127.1
6,149,014 A 11/2000 Mankosa et al.
6,303,241 B1 10/2001 Miles

* cited by examiner

*Primary Examiner*—Donald P. Walsh
*Assistant Examiner*—Joseph C Rodriguez
(74) *Attorney, Agent, or Firm*—Oyen Wiggs Green & Mutala

(57) ABSTRACT

A magnetic separator system comprises a feed chute having an adjustable feed chute floor portion for controlling the release of discharge slurry from the feed chute onto a rotating magnetic drum separator. Adjusting the adjustable chute floor portion controls where discharge slurry released from the feed chute contacts the outer surface of the drum, allowing the contact point to be maintained for optimal separation simply through such adjustments. Precise control over flow of discharge slurry onto the drum notwithstanding variations in flow of discharge slurry permits the system to use an open construction, which is more compact and which reduces wear and abrasion and makes the system more accessible for repair. The field of attraction from magnets within the drum extends not only around the circumference of the drum, but also into the feed chute over the adjustable feed chute floor portion. This enables magnetic separation to take place in two phases: both while the discharge slurry is still flowing in the feed chute, and after the discharge slurry falls into contact with the drum. The drum is preferably covered by a replaceable protective lining constructed in segments that are easily installed and removed, but which overlap and interlock with one another to form a sealed protective lining.

43 Claims, 10 Drawing Sheets

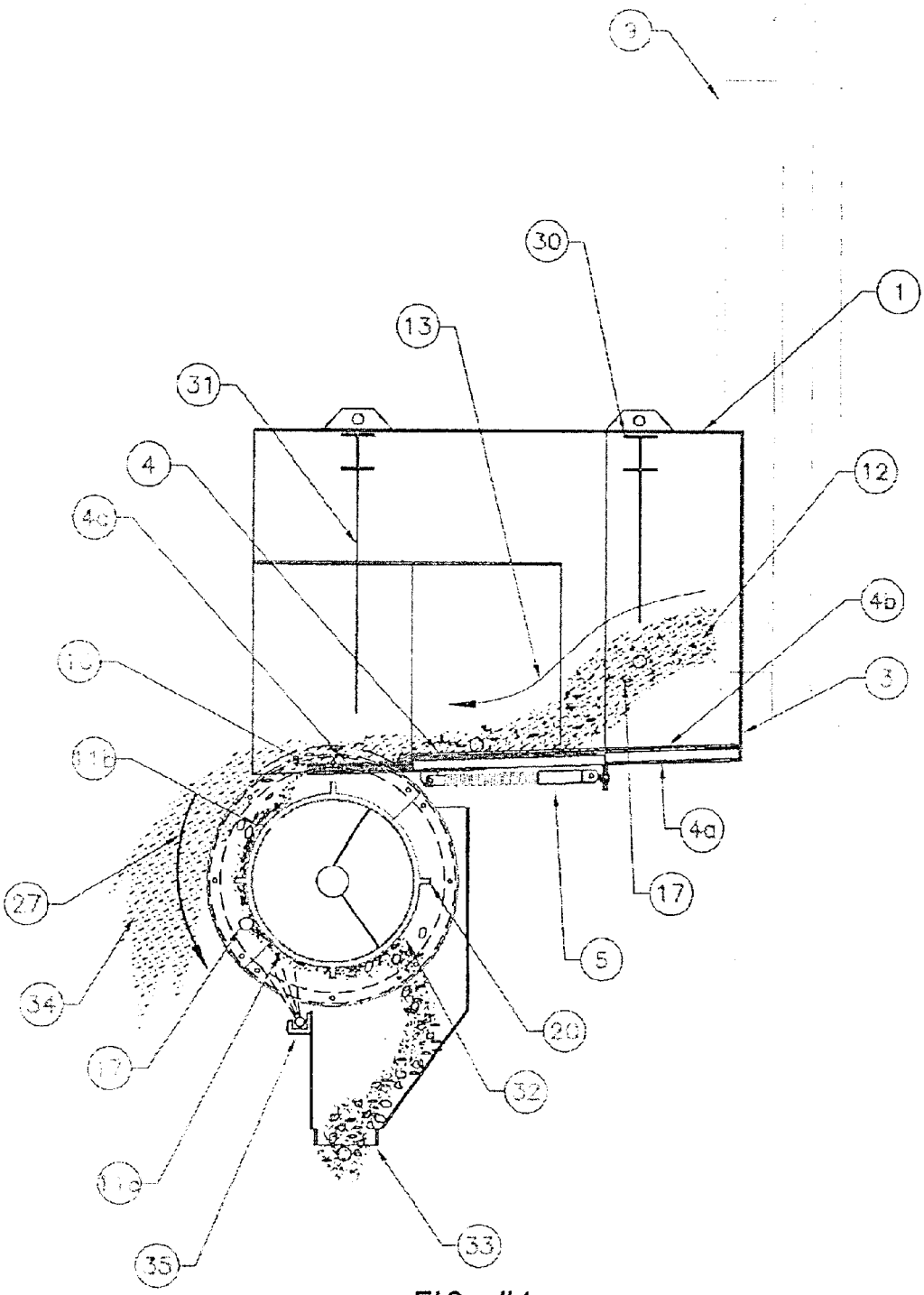
FIG #1

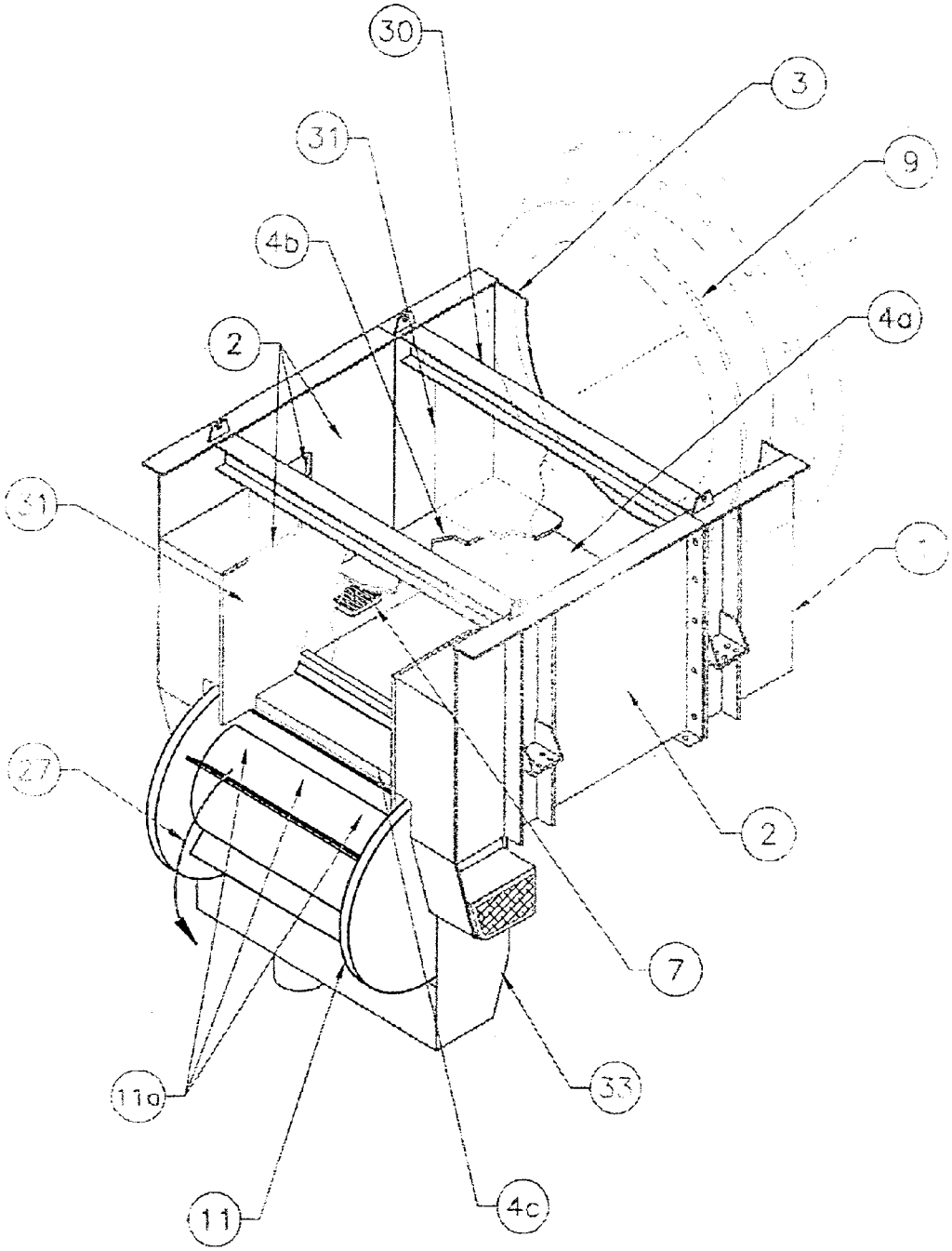
FIG #2

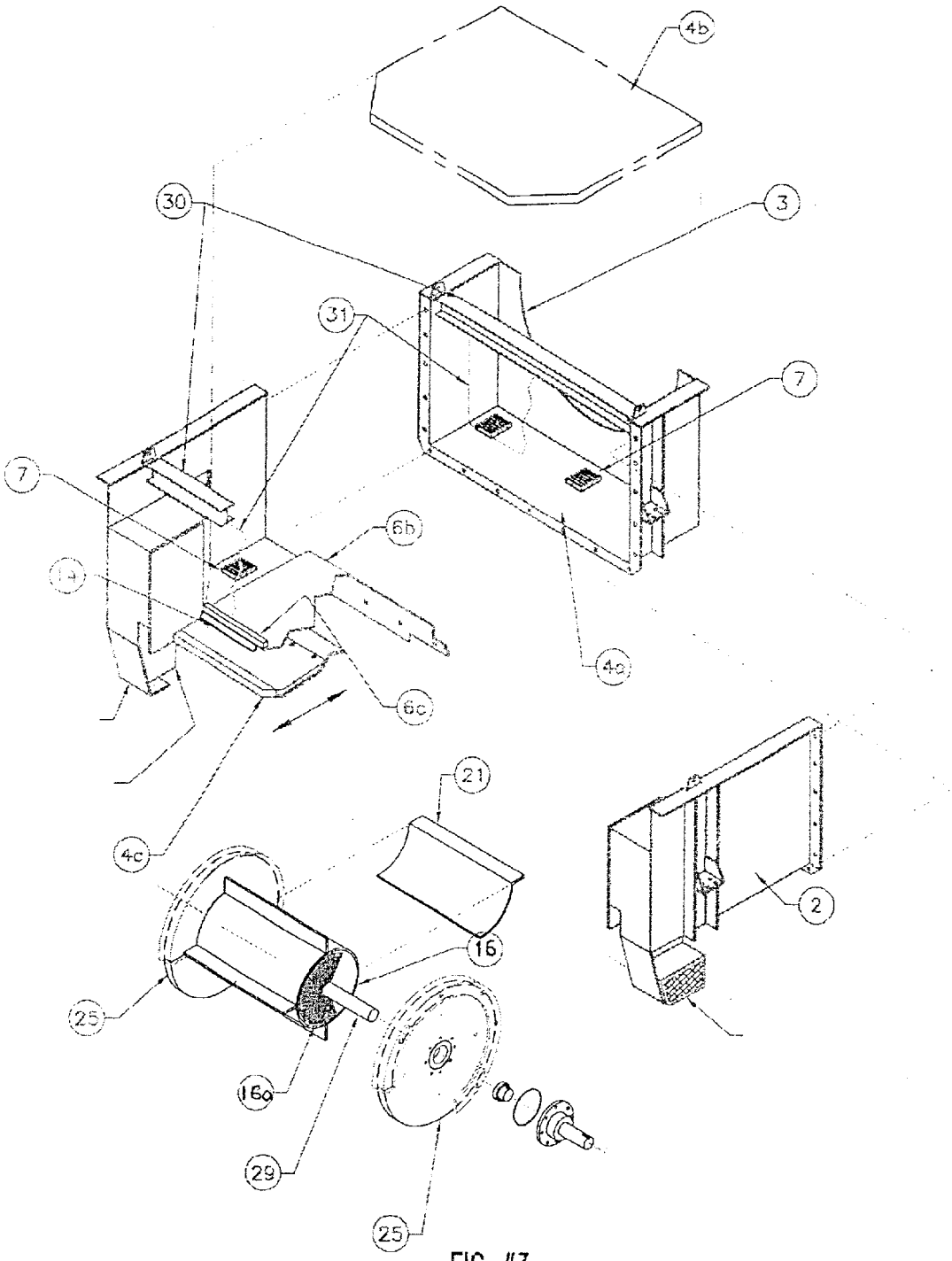
FIG #3

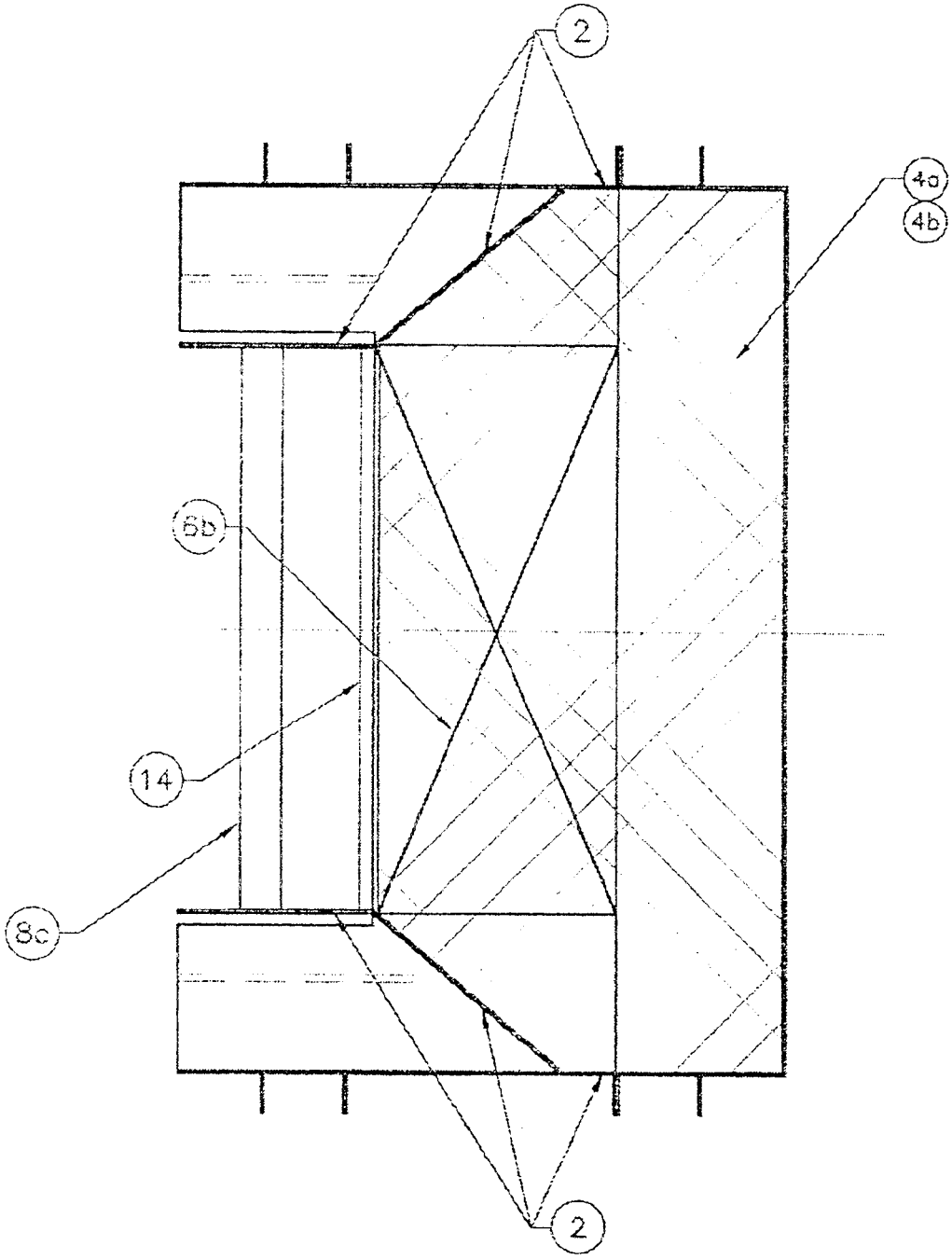
FIG #4

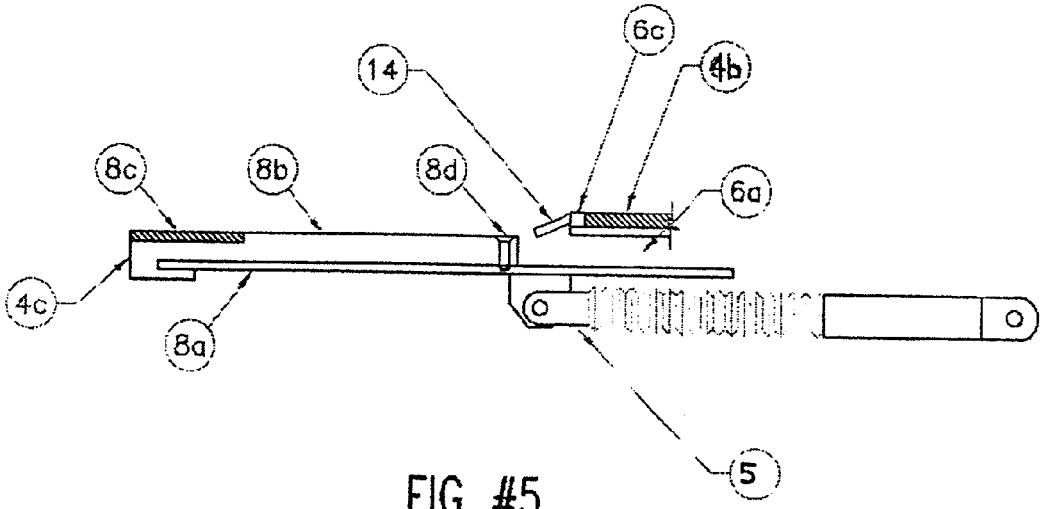
FIG #5
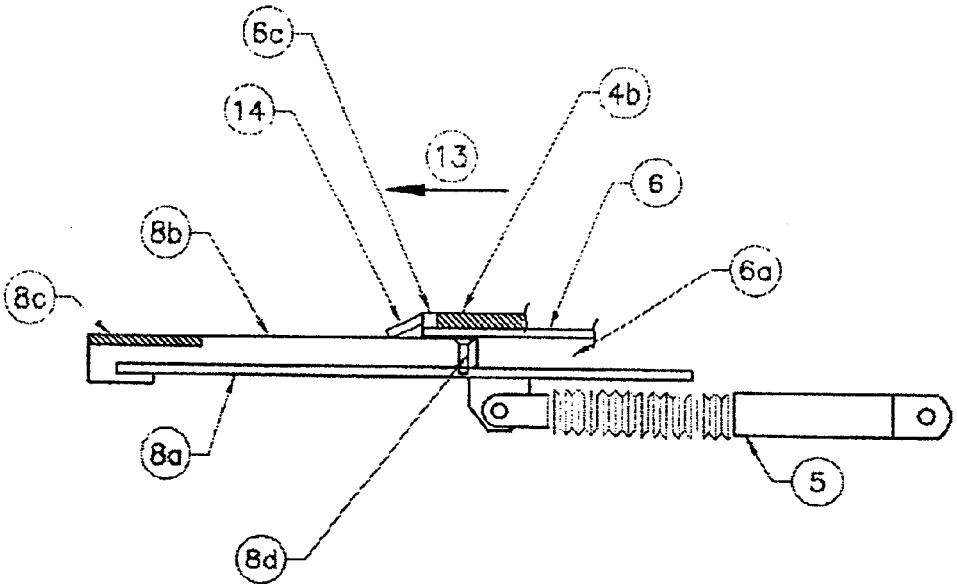
FIG #6

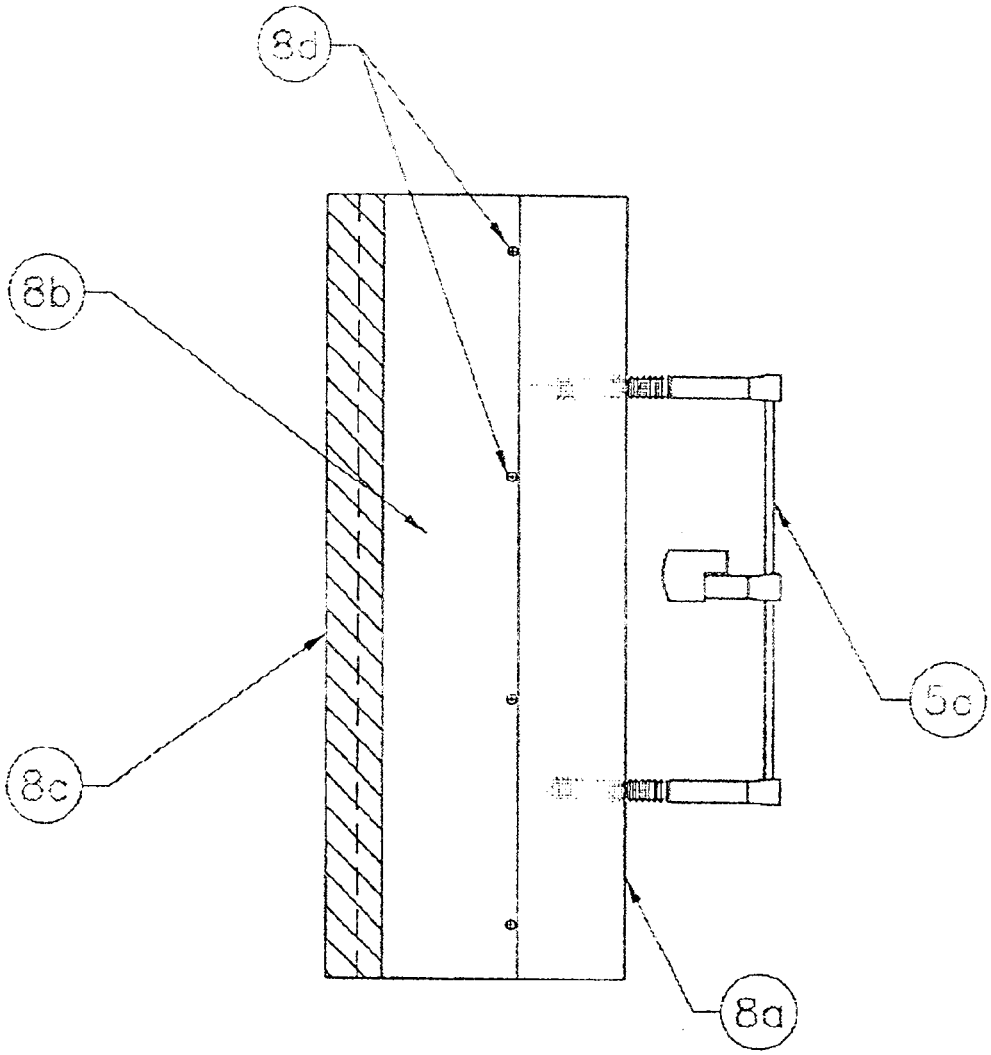
FIG #7

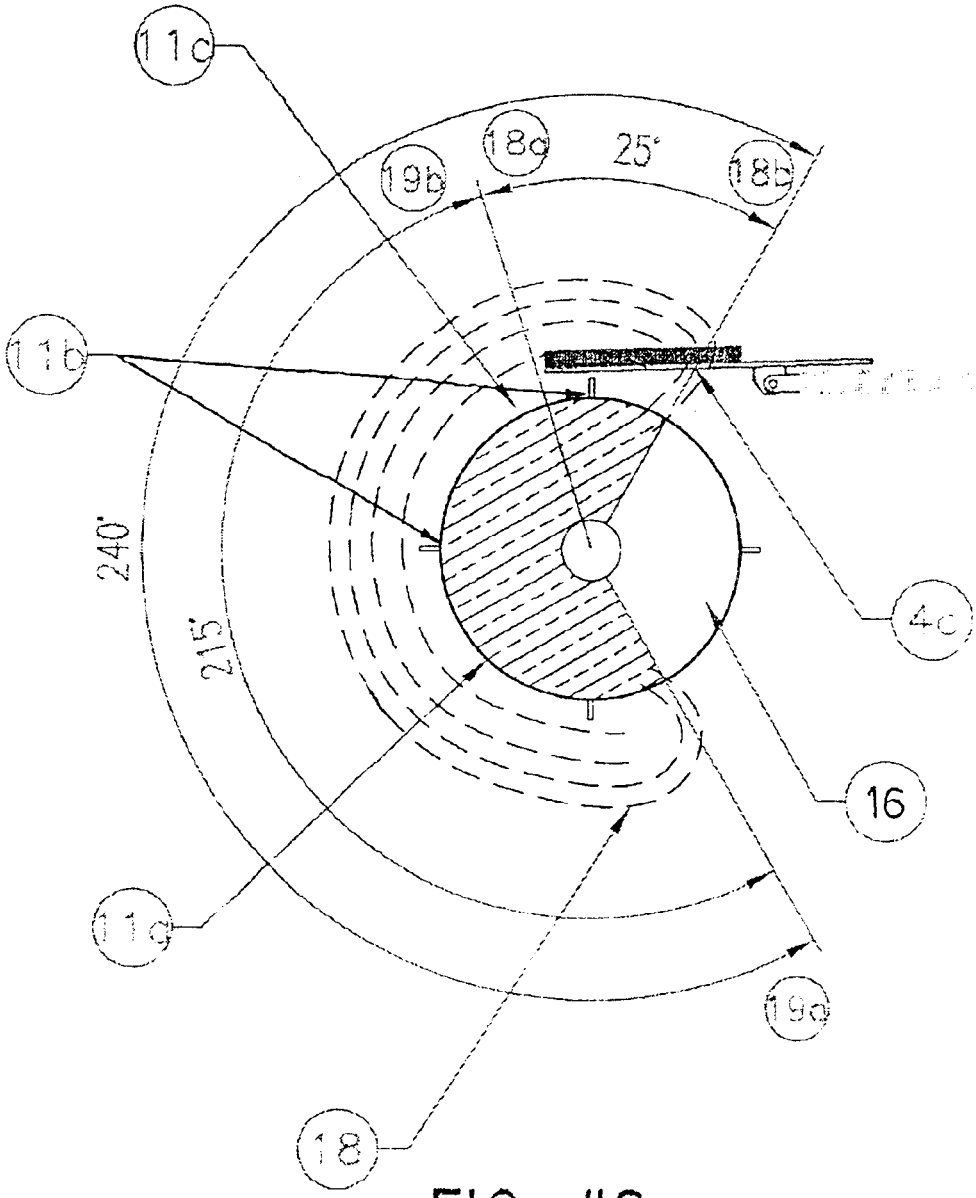
FIG #8

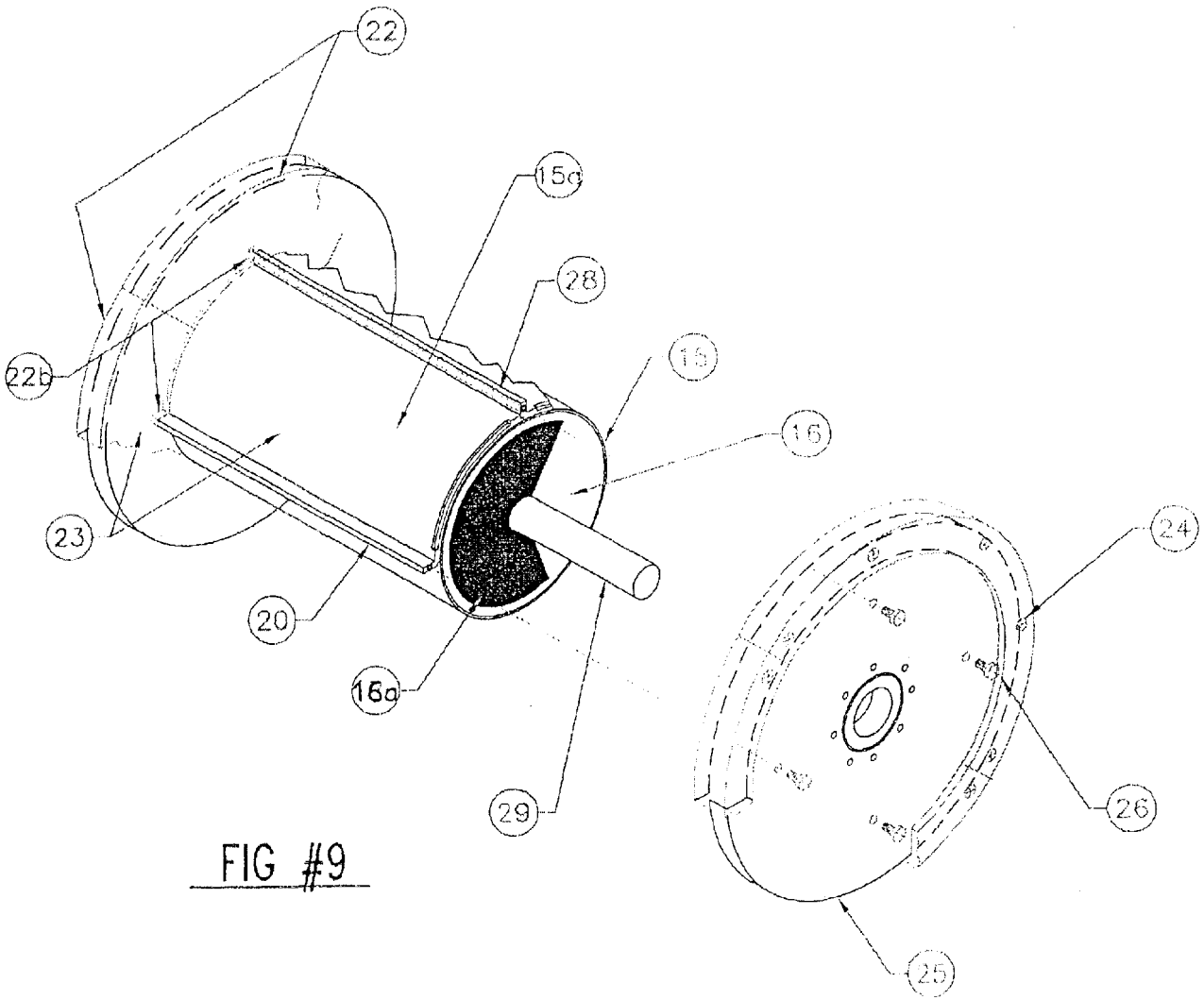
FIG #9

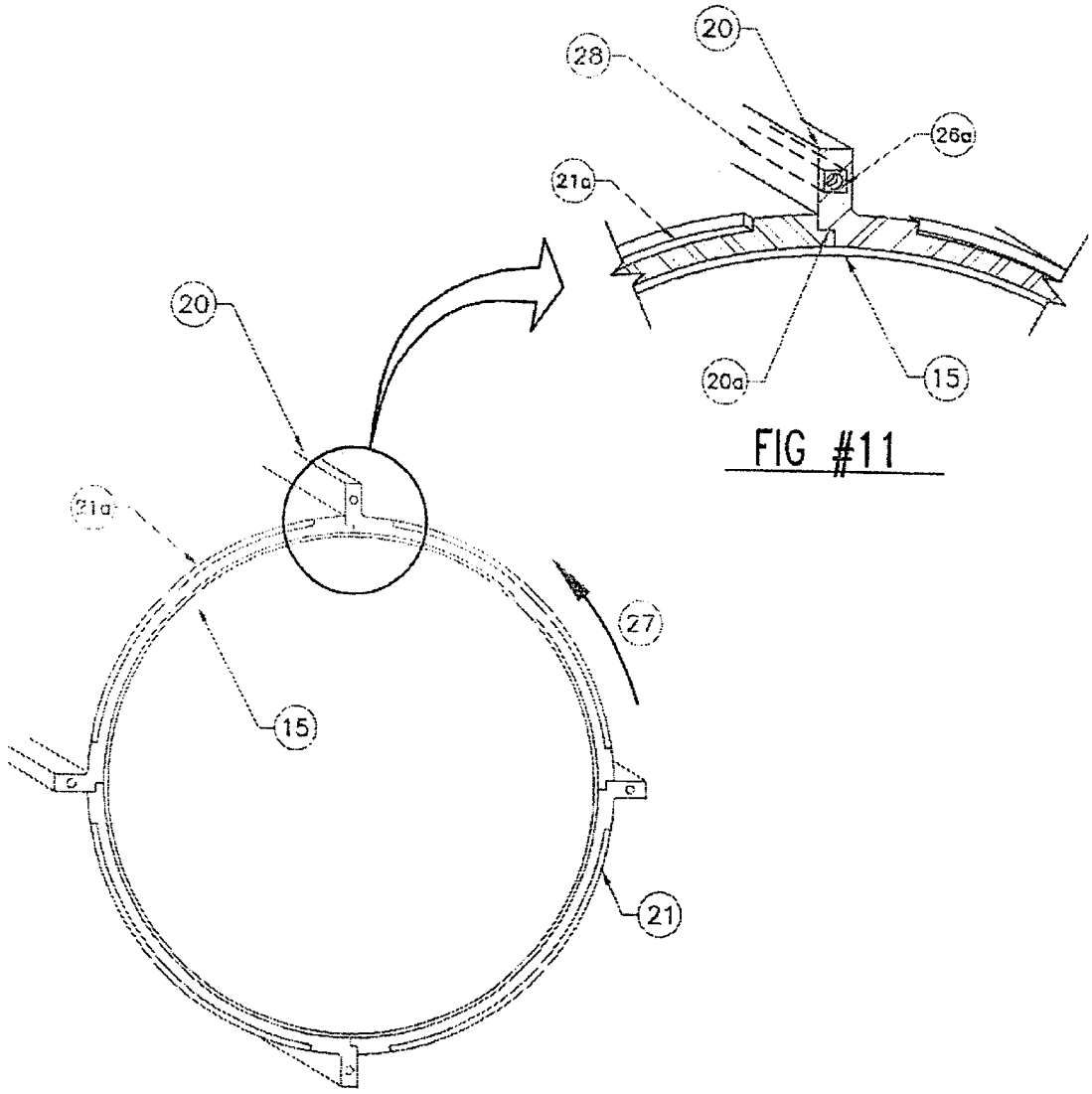
FIG #11
FIG #10

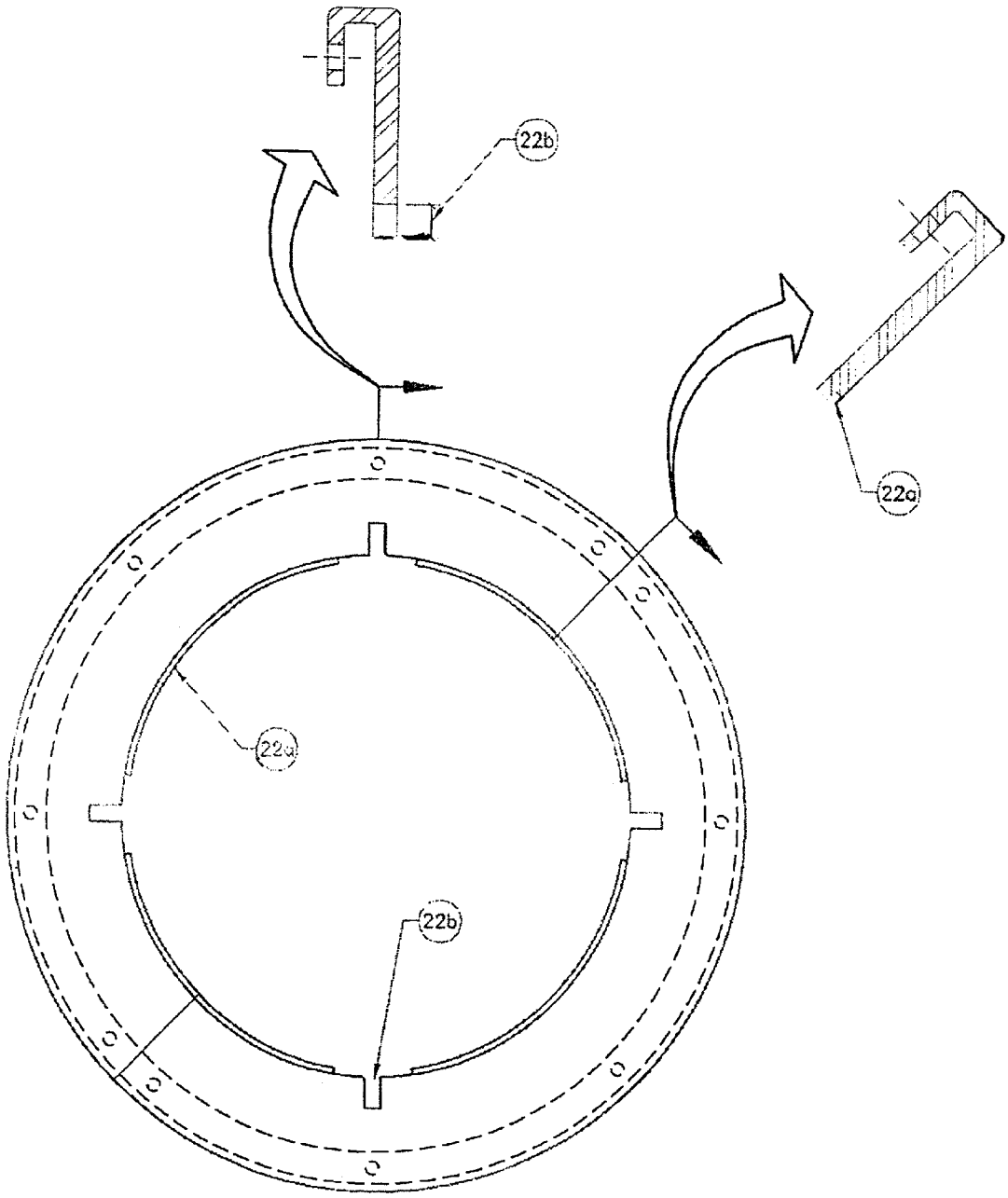
FIG #12

MAGNETIC SEPARATION SYSTEM AND METHOD FOR SEPARATING

TECHNICAL FIELD

This application relates to a system for separating metallic contaminants from an ore slurry.

BACKGROUND

The mining industry utilizes various devices to separate valuable minerals from host contaminants after extraction from the earth. Initially, the ore preparation procedure involves crushing the run-of-mine rock from several feet in size down to approximately 1 to 3 inches. This preliminary crushing step is followed by one or more stages of grinding to reduce the ore to an average size of less than 1 millimeter. These latter grinding steps typically use large rotating cylindrical mills containing a charge of spherical steel balls that are used as a grinding media. The balls are in a constant tumbling motion due to the rotation of the mill. The ore is fed into one end of the mill, progresses through the grinding chamber, and is discharged from the opposite end. As the ore progresses through the mill, the grinding media impacts the material, resulting in fracture and breakage of the individual pieces into smaller and smaller particles.

The tumbling motion of the balls can also result in fracture of the balls themselves. Additionally, mechanical abrasion will wear the ball surface causing a reduction in size of the grinding media. The net results of this process are the generation of various shapes of steel which are significantly smaller than the original spherical balls, and the further contamination of the ore with metal fragments from the balls. Depending on the mill design, these fragments will discharge with the ground-up ore particles and flow to downstream equipment.

The ball fragments cause two distinct problems in ore processing facilities. The first is wear on subsequent equipment. Grinding is typically a wet process and the ore/water slurry is pumped between various unit operations. The metallic fragments cause significant wear on pumps, piping, and other downstream equipment. The costs associated with maintenance downtime and equipment repair/replacement can be substantial. Second, the ball fragments reduce the efficiency of the grinding mill itself. In most grinding operations, the balls and ball fragments that discharge from the grinding mill are returned to the grinding circuit with new ore feed. As a result, a substantial build-up of fragments can occur in the grinding mill occupying volume that would otherwise be filled by mineral slurry. This loss in active mill volume can decrease the mill capacity by a substantial amount. Furthermore, the small mass of the fragments does not provide a sufficient impact force to effectively fracture the mineral particles in the grinding mill.

U.S. Pat. No. 2,332,701 recognizes the problem represented by worn and fragmented grinding media in ball mills, and discloses a ball mill that continuously discharges grinding media with the ground material and returns to the feed end of the mill only that portion of the grinding media which is in good condition and of the correct size. A trommel screen sorts the output and an elevator conducts the useful grinding media back to the feed end of the mill. However, the trommel screen would not be able to separate out ball fragments smaller than the holes in the trommel screen, and the trommel screen cannot be made too fine or else it would become clogged by the ore slurry.

Recognizing the limitations of physical screening/separation, methods have been developed in the art for separating ferrous material from non-ferrous wet or dry materials using magnetic drum separators, which are well-known in the art. One of such methods is exemplified by U.S. Pat. No. 6,149,014, which discloses a top-fed, wet magnetic drum separator to remove metallic contaminants from the discharge slurry of an operating grinding mill. In the invention disclosed in U.S. Pat. No. 6,149,014, slurry discharging from the grinding mill enters an enclosed feed box located on top of the separator. The enclosed feed box provides a physical velocity break, minimizes turbulence, and then spreads the mineral slurry on the drum surface in a contained manner by means of a flexible "feed introducer" that extends from the feed box to actually engage the drum surface; the velocity break section is expressly required to be large enough to provide overflow of feed material. The feed box and drum surface are rubber-lined to minimize wear. Barrier walls attached to and rotatable with the drum surface contain the flow of slurry in conjunction with a sealed, curved, stationary cover located over the barrier walls to force slurry around the curvature of the drum, thereby maintaining the slurry in sufficient contact with the drum to enable magnetic separation to take place. Without the cover to contain it, the slurry would tend to be ejected from the enclosed feed box at a relatively high velocity with little contact with the drum surface and little opportunity for magnetic separation to take place. Once the cover forces the slurry into contact with the drum, a fixed magnet assembly arranged in an arc within the drum from approximately 26 to 218.5 degrees (pole center-to-center) starts attracting ferrous material within that slurry so as to begin the process of magnetic separation.

Further, U.S. Pat. No. 6,149,014 teaches the use of cleats on the drum surface to ensure transfer of metal fragments around the drum surface and discharge beyond the last pole. A partitioned product hopper is located around the lower portion of the separator, configured with a physical splitter positioned before the last pole to physically partition metallic fragments from the slurry. A drum spray bar is located beyond the last pole to remove solids that continue to adhere to the drum surface after the slurry and any metal fragments have fallen off, to prepare and clean the drum surface to receive further slurry from the feed box for separation.

The method and apparatus used in the U.S. Pat. No. 6,149,014 invention have a number of disadvantages:

(1) Expressly required by U.S. Pat. No. 6,149,014 is an enclosed discharge slurry feed box large enough to provide for overflow capacity and a velocity break section, resulting in unnecessary size and capacity to hold the tremendously large volumes of discharge slurry that are periodically generated during the grinding mill production cycle. The overflow capacity necessarily requires the feed box capacity be sufficiently large to accommodate maximum volume, which is wasteful, and thereby underutilizes that capacity at other times, necessarily making the U.S. Pat. No. 6,149,014 invention excessively large when space constraints are often a prevalent concern in or around grinding mills. This excess volume capacity and size, renders the invention less useful in many field applications without expensive retrofits.

(2) In the U.S. Pat. No. 6,149,014 invention, all of the discharge slurry is forced through an enclosed feed box and directly into a very confined conduit made up of the outer surface of the drum shell, the barrier walls, and the stationary cover. Therefore, the velocity break section in the feed box is essential to prevent the slurry from overwhelming the magnetic drum, there being no other means provided for this purpose. This necessarily increases the amount of wear and abrasion in the feed box, on the outer surface of the drum shell, on the barrier walls, and on the stationary cover used to guide the slurry around the curvature of the outer surface of the drum shell.

(3) In addition to the wear and abrasion created by the full volume and rate of flow emanating from the discharge slurry, the invention is a fully enclosed system that can generate head pressure within the confines of the internal vessels and greatly increases the risk of wear, abrasion, and internal damage.

(4) The U.S. Pat. No. 6,149,014 invention is fully enclosed, making it difficult to maintain and repair. Although it is internally lined with rubber to resist wear and abrasion, standard rubber lining is not designed for quick replacement and is not easily accessible without substantially dismantling the device. This is a costly and time-consuming problem, especially in the milling industry where long shutdowns for repair or replacement are extraordinarily expensive for milling operations.

(5) The system disclosed in U.S. Pat. No. 6,149,014 would not work if it were not fully enclosed. The stationary cover is required to contain the slurry against the outer surface of the drum; otherwise, any slurry being ejected from the enclosed feed box at high velocity or volume would not be kept within sufficient contact with the drum to enable magnetic separation to take place.

SUMMARY OF INVENTION

This invention provides a magnetic separator system comprising an open trunnion discharge feed chute and an open magnetic drum separator for separating ferrous material from a discharge slurry. In particular, a magnetic separation system according to the present invention comprises:

(1) a feed chute for receiving discharge slurry, the feed chute comprising walls and a feed chute floor, the feed chute floor having an adjustable feed chute floor portion for controlling the release of discharge slurry from the feed chute; and (2) a magnetic drum separator comprising a drum rotatable about an axis below the feed chute, the drum having a generally cylindrical outer surface and having a fixed magnet assembly within that rotating outer surface.

By adjusting the adjustable chute floor portion, the user can control where discharge slurry released from the feed chute contacts the outer surface of the drum. Therefore, simply by adjusting the adjustable chute floor portion of the feed chute, the flow of discharge slurry can be made to contact the outer surface of the drum only at the optimal point of contact, and that optimal point of contact can be maintained in this same way, thereby compensating for variations in the flow of discharge slurry. This ability to control with precision the flow of discharge slurry onto the outer surface of the drum permits the system to use an open construction, rather than an enclosed construction as required in prior art system to force discharge slurry into contact with the drum. This open construction not only reduces wear and tear given that discharge slurry is no longer being forced through physical enclosures, but the open construction also provides greater ease of accessibility for repair and replacement where needed. Further, the open feed chute eliminates the need for an unnecessarily large feed box with a separate overflow section, so the magnetic separation system of this invention can be of a more compact construction. Also, a physical velocity break is no longer necessary since this invention already compensates for variations in flow of discharge slurry.

In operation, a method of removing ferrous material from a discharge slurry flow according to this invention comprises:

(1) discharging discharge slurry into the feed chute described above;

(2) releasing the discharge slurry from the feed chute onto the outer surface of the rotating drum described above;

(3) rotating said outer surface of the drum in the direction of the flow of said discharge slurry;

(4) adjusting the adjustable feed chute floor portion so as to maintain, at a predetermined point, the area at which discharge slurry released from the feed chute contacts the outer surface of the drum;

(5) separating ferrous material from the discharge slurry by magnetically attracting ferrous material to the drum while allowing non-ferrous discharge slurry to flow past and off the drum; and (6) conveying ferrous material away from the non-ferrous discharge slurry and then discharging the ferrous material from the drum at a different location.

The radial field of magnetic attraction provided by the fixed magnet assembly preferably extends not just around the circumference of the drum, but also into the feed chute over the adjustable feed chute floor portion. This enables magnetic separation to take place in two phases: the first phase taking place while the discharge slurry is still flowing in the feed chute, and the second phase taking place after the discharge slurry falls into contact with the outer surface of the drum.

Preferably, the drum is covered by a replaceable protective lining constructed in segments that are easily installed and removed, but which overlap and interlock with one another to form a sealed protective lining. The segments are all preferably constructed of a non-ferrous elastomeric material. The outer surface of the drum also preferably has a plurality of cleats to assist the transfer of ferrous material around that outer surface. The cleats are preferably strengthened by a metallic bar through the length of each cleat.

An electronically-controlled adjuster can be programmed to automatically adjust the adjustable feed chute floor portion in response to variations in flow of discharge slurry. Further, a variable speed motor can be used to rotate the drum, varying the speed of rotation in response to variations in the flow of discharge slurry. This would not have been effective in respect of prior art enclosed systems, since increasing the speed of rotation would simply create more pressure within the physical enclosures and cause more wear and abrasion.

BRIEF DESCRIPTION OF DRAWINGS

FIG. 1 is a cross-sectional side view showing a magnetic separation system according to the invention, comprising an open trunnion discharge feed chute and a magnetic drum separator.

FIG. 2 is a top perspective, partially cut-away view of the magnetic separation system of FIG. 1.

FIG. 3 is an exploded top perspective, partially cut-away view of the magnetic separation system of FIG. 2.

FIG. 4 is a top plan view of the feed chute portion of the magnetic separation system.

FIG. 5 is a cross-sectional side view of an adjustable flow plate forming a portion of the floor of the feed chute, showing said adjustable flow plate in a position fully extended from its flow plate housing so as to permit replacement of that adjustable flow plate.

FIG. 6 is a cross-sectional side view of the adjustable flow plate in an operating position.

FIG. 7 is a top plan view of the fully extended adjustable flow plate of FIG. 5.

FIG. 8 is a schematic cross-sectional side view of the magnetic drum separator portion of the magnetic separation system.

FIG. 9 is an exploded perspective view of the magnetic drum separator.

FIG. 10 is a schematic perspective side view of the outer shell and protective drum liner of the magnetic drum separator.

FIG. 11 is a close-up, schematic perspective side view of a portion of the outer shell of the magnetic drum separator showing how two adjacent liner segments overlap, interlock, and seal.

FIG. 12 is a front elevation view and partially cross-sectional side view of a protective sidewall liner for an end plate of the magnetic drum separator.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

As illustrated in FIGS. 1, 2, and 3, a magnetic separator system according to the invention comprises an open trunnion discharge feed chute 1 and a magnetic drum separator 11 for separating ferrous material 17 from a discharge slurry 12. Discharge slurry 12 comprises ferrous material 17, crushed ore, and water. Ferrous material 17 comprises worn grinding media chips and other ferrous particles.

Trunnion Discharge Feed Chute

Referring to FIGS. 1, 2, 3, 4, and 6, feed chute 1 comprises two chute walls 2, a rear backwash retainer 3, and a chute floor 4. Structural cross supports 30 connect chute walls 2 above chute floor 4, and an optional rubber damper curtain 31 is suspended from each structural cross support 30. Chute floor 4 in turn comprises:

(1) a fixed floor segment 4*a;*

(2) a replaceable, ferrous, abrasion-resistant floor wear plate 4*b;* and (3) an adjustable flow plate 4*c* retractable into a flow plate housing 6 below floor wear plate 4*b*.

As shown in FIGS. 3, 5, and 6, adjustable flow plate 4*c* retracts into a flow plate housing 6. In particular, adjustable flow plate 4*c* retracts into a recessed area 6*a* of flow plate housing 6. Flow plate housing 6 is attached to fixed floor segment 4*a* such that the upper surface 6*b* of flow plate housing 6 is flush with and contiguous to the upper surface of fixed floor segment 4*a*. Floor wear plate 4*b* is then attached above fixed floor segment 4*a* and upper surface 6*b*. The result is a relatively smooth chute floor 4 with a very mild downward slope (approximately 2% to 3%) from backwash retainer 3 to the leading edge 10 of adjustable flow plate 4*c*. Floor wear plate 4*b* may be attached to fixed floor segment 4*a* and upper surface 6*b* by various means, but preferably by the use of a magnetic wear plate retainer 7 such as that taught in U.S. Pat. No. 6,303,241. Where floor wear plate 4*b* is attached to fixed floor segment 4*a* and upper surface 6*b* by magnetic means such as wear plate retainer 7, then preferably, as shown in FIGS. 3, 5, and 6, a wear plate stop 6*c* extends upwardly from the outer edge of upper surface 6*b* to further prevent any horizontal movement or slippage in floor wear plate 4*b*. A rubber wiper 14 extends outwardly from wear plate stop 6*c* and downward toward adjustable flow plate 4*c* in order to provide a smooth transition from floor wear plate 4*b* to adjustable flow plate 4*c* for discharge slurry 12. In the top plan view of feed chute 1 illustrated in FIG. 4, the area in fine crosshatching represents floor wear plate 4*b*, and the large superimposed single cross represents that portion of floor wear plate 4*b* covering upper surface 6*b* of flow plate housing 6.

Adjustable flow plate 4*c* should be comprised of a non-ferrous abrasion-resistant wear plate or a non-ferrous elastomer, the preferred embodiment being an 80A durometer polyurethane (such as Uniroyal Vibrathane™ 8083). Adjustable flow plate 4*c* extends outward from or retracts inward into flow plate housing 6 to permit the length of chute floor 4 along the bottom of feed chute 1 to be adjusted. Adjustable flow plate 4*c* may be actuated inward or outward by means of actuators 5 located beneath chute floor 4. In FIGS. 1, 5, and 6, actuators 5 are depicted as synchronized ball-screw actuators, but actuators 5 can take the form of any suitable actuators, including mechanical, electric, pneumatic, or hydraulic actuators.

Referring to FIGS. 5 and 6, adjustable flow plate 4*c* preferably comprises three components:

(1) the lower surface being a non-ferrous steel structural supporting plate 8*a;*

(2) the upper surface being a replaceable non-ferrous wear surface 8*b;* and (3) the leading edge 10 of adjustable flow plate 4*c* comprising a highly wear-resistant, non-ferrous ceramic material forming a ceramic leading edge 8*c*.

Wear surface 8*b* may be attached to support plate 8*a* by any suitable means, including by means of stainless steel countersunk fastening screws 8*d* as illustrated in FIGS. 5 and 6. Wear surface 8*b* may be comprised of a non-ferrous abrasion-resistant wear plate or a non-ferrous abrasion-resistant elastomer such as a polyurethane. Wear surface 8*b* in its preferred embodiment is comprised of a highly abrasion-resistant 80A durometer polyurethane material (Uniroyal Vibrathane™ 8083), but could be comprised of any number of other non-ferrous elastomeric, metallic or composite materials, including ceramic or non-ferrous steel, to enhance the non-abrasive properties of wear surface 8*b*. Although wear surface 8*b* is highly abrasive-resistant on its own, the embedding of ceramic leading edge 8*c* is a preferred embodiment, by reason of the increased longevity offered by the even more abrasion-resistant protection provided by ceramic leading edge 8*c*.

Wear surface 8*b* should be a non-ferrous material to ensure that there is no interference with the magnetic field configuration generated by magnetic drum separator 11, which, as explained in detail below, extends upwardly from magnetic drum separator 11 to affect discharge slurry 12 even as it flows over adjustable flow plate 4*c*. Ceramic leading edge 8*c* and fastening screws 8*d* should be non-ferrous for the same reason.

For ease of replacement of wear surface 8*b*, adjustable flow plate 4*c* is preferably fully extendable outward from flow plate housing 6 such that the entirety of wear surface 8*b* is extendable beyond rubber wiper 14 for ease of access to fastening screws 8*d*. This is illustrated in FIG. 5, where actuators 5 are fully extended in order to extend wear surface 8*b* beyond rubber wiper 14. While adjustable flow plate 4*c* is fully extended as shown in FIG. 5, wear surface 8*b* is easily removed from supporting plate 8*a* by unscrewing fastening screws 8*d*. A new replaceable wear surface 8*b* can then be fitted into place and re-fastened using fastening screws 8*d*. Adjustable flow plate 4*c* can then be retracted inwardly into flow plate housing 6 to an operating position as shown in FIG. 6. In its operating position, wear surface 8*b* is partially retracted under upper surface 6*b* of flow plate housing 6, and fastening screws 8*d* are protected from exposure to the abrasive effects of discharge slurry 12. As illustrated in FIG. 6, the surface seal offered by rubber wiper 14 prevents discharge slurry 12, which is flowing in direction 13, from flowing backwards into recessed area 6*a* of flow plate housing 6.

Magnetic Drum Separator

Referring to FIGS. 1, 2, 3, and 9, magnetic drum separator 11 comprises a magnetic drum 16 rotatable in direction 27 about a drum shaft 29 supported for axial rotation below feed chute 1. As shown in FIG. 9, an end plate 25 is inserted onto drum shaft 29 at each of the two ends of magnetic drum 16 and attached in place by any suitable means. End plates 25 serve as barrier walls to prevent discharge slurry 12 or ferrous material 17 from spilling over the sides of magnetic drum 16. Otherwise, magnetic drum 16 is completely unenclosed. In particular, there is no cover element that physically forces discharge slurry 12 into contact with magnetic drum 16. There is also no "feed introducer" or any other flexible element that extends from feed chute 1 into physical engagement with magnetic drum 16 to physically force discharge slurry onto magnetic drum 16.

Within magnetic drum 16 are one or more magnetic elements 16*a* comprising either ferrite or rare-earth magnetic material or a combination thereof. Referring to FIGS. 1, 3, and 8, magnetic elements 16*a* are arranged within magnetic drum 16 in an arc from approximately negative 25 degrees (measured relative to the "12:00 o'clock" dead center position at the top of magnetic drum 16, and measured in rotation direction 27) to positive 215 degrees, providing a 240-degree radial field of magnetic attraction 18 about the circumference of magnetic drum 16. Referring to FIG. 8, the initial negative 25 degrees from the 12:00 o'clock dead center portion of the 240 degree radial field of magnetic attraction 18 is an important advance over the prior art, by reason that it permits field of magnetic attraction 18 to extend over a portion of chute floor 4, namely adjustable flow plate 4*c*. In the known prior art, the magnetic field of attraction was designed to commence only at or near the point where the discharge slurry first contacts the magnetic drum. In the present invention, however, the field of magnetic attraction 18 emanating from magnetic drum separator 11 operates not only on ferrous material 17 after discharge slurry 12 falls from feed chute 1 into contact with the outer drum surface 11*a* of magnetic drum separator 11, but it also operates on ferrous material 17 even while discharge slurry 12 is still flowing within feed chute 1 over adjustable flow plate 4*c*. This feature is explained in more detail below.

Referring to FIGS. 1, 3, and 9, magnetic drum 16 has an outer shell 15 from which outwardly extends a plurality of cleats 20. Cleats 20 constitute a reliable means of ensuring ferrous material 17 is forced along the outer surface 11*a* of magnetic drum separator 11 as magnetic drum 16 rotates in direction 27. Each of cleats 20 is preferably at least one inch high, and made of wear-resistant material. Also, in order for magnetic drum separator 11 to function properly and effectively, each of cleats 20 should be composed of a non-ferrous material to avoid interference with the field of magnetic attraction 18 generated by magnetic drum separator 11.

In a preferred embodiment of this invention, cleats 20 are integrated into a replaceable abrasion-resistant outer drum liner 15*a* covering outer drum shell 15. In a particularly preferred embodiment illustrated in FIG. 10, outer drum liner 15*a* comprises a plurality of replaceable non-ferrous curved liner segments 21 each having a cleat 20 as an integral part thereof along one straight edge thereof, which plurality of liner segments 21 together overlap and interlock to form outer drum liner 15*a*, each cleat 20 acting as a seal between adjacent liner segments 21 by overlapping a cleat joint edge 20*a* of the adjoining liner segment 21. Liner segments 21 are preferably equal in size, for interchangeability and ease of replacement as well as for more effective movement of ferrous material 17 along outer drum surface 11*a*. Accordingly, the present invention utilizes cleats 20 not only to achieve the well-known function of forcing ferrous material 17 along outer drum surface 11*a*, but also to produce a novel overlapping seal between the plurality of liner segments 21 that together form outer drum liner 15*a*, as best illustrated in FIGS. 10 and 11.

Referring to FIGS. 9 and 12, each end plate 25 preferably also has a protective liner in the form of a non-ferrous replaceable abrasion-resistant sidewall liner 22. Each sidewall liner 22 is preferably of a two-piece construction for ease of replacement and designed for overlapping, interlocking, sealing fit with outer drum liner 15*a*. As shown in FIGS. 10 and 11, each liner segment 21 has a recess 21*a* at each of its ends for receiving a corresponding edge of sidewall liner 22. In this regard, as shown in FIG. 12, each sidewall liner 22 has a corresponding keyed edge 22*a* for an overlapping, interlocking, sealing fit with a corresponding recess 21*a* of a liner segment 21. Each sidewall liner 22 also has a recess 22*b* for interlocking fit and seal with each of the plurality of cleats 20. Sidewall liners 22 are attached to end plates 25 by means of fasteners 24 or other suitable means. By way of example, in FIG. 9, fasteners 24 are depicted as stainless steel fastening screws, although other known fastening means will work as well.

The combination of all surface liner segments 21 and sidewall liners 22 joined together at the respective sealed joints form a non-ferrous abrasion-resistant replaceable lining 23 for the entire magnetic drum separator 11. Although the components of separator lining 23, namely liner segments 21 and sidewall liners 22, may be comprised of either a non-ferrous metallic alloy material or an elastomeric material, the preferred embodiment is a non-ferrous highly abrasion-resistant elastomeric material such as an 80A durometer polyurethane material (Uniroyal Vibrathane™ 8083), which can also be impregnated with ceramic or other highly abrasion-resistant materials into the elastomeric host material for even greater abrasion-resistant capability. Prior art magnetic drum separators are usually lined with a non-ferrous metal such as stainless steel, although U.S. Pat. No. 6,149,014 discloses a rubber lining.

This invention provides a novel overlapping and interlocking arrangement between the various components forming the separator lining 23, which allows the advantages of ease of installation and removal of the component parts for repair and replacement, while maintaining a secure fit and strong protective seal against the highly abrasive discharge slurry 12 during operation. In addition to the novel overlapping and interlocking arrangement between the plurality of surface liner segments 21 and sidewall liners 22 forming a secure fit and protective seal between the components of separator lining 23, recesses 22*b* at the base of sidewall liners 22, corresponding to and receiving the protruding ends of cleats 20, further anchor and strengthen both cleats 20 and the entire separator lining 23 simultaneously. Although there are many means or methods of overlapping and interlocking independent surface segments, the design depicted in FIGS. 9, 10, 11, and 12 for separator lining 23 is the preferred embodiment, as it combines ease of assembly for onsite field installations with structural strength of overlapping and interlocking joints. This serves to seal the joints between liner segments 21 and sidewall liners 22 to protect the underlying surface of outer drum shell 15 from exposure to the highly abrasive discharge slurry 12. The overlapping and interlocking surface segments comprising separator lining 23 act to seal the joints between liner segments 21 and sidewall liners 22, but for added sealing capabilities, a urethane sealing agent can easily be introduced at these points during assembly and change-out, where the field application necessitates it.

In addition to the strength offered by the overlapping and interlocking joints of liner segments 21, particularly at cleats 20, the preferred embodiment of the invention includes a further strengthening device in the form of a non-ferrous metallic bar 28 within each cleat 20, as shown in FIGS. 9, 10, and 11. Metallic bar 28 can be made of stainless steel or a non-ferrous alloy shaped as a round or rectangular bar. Metallic bar 28 is embedded into and runs the entire length of each cleat 20. At each end of each metallic bar 28 is preferably a threaded insert 26*a* into which a fastener 26 can be threaded to securely attach each liner segment 21 to end plates 25. Fasteners 26 can, for example, be stainless steel fastening screws that screw through holes in end plates 25 into threaded inserts 26*a*, and securely fasten the ends of cleats 20 into corresponding recesses 22*b*. The extremely high volume and rate of flow of discharge slurry 12 from most medium and large-sized grinding mills place tremendous flow force on the outer drum surface 11*a*, and particularly at cleats 20, which constitutes the area of greatest loading of the massive volume and weight of discharge slurry 12. Metallic bars 28 assist in maintaining the strength, shape and structured integrity of outer drum liner 15*a*, especially at cleats 20.

The components of a magnetic separation system according to the present invention are designed for ease of field maintenance, and to allow quick and easy replacement of all worn, abraded, or damaged surfaces during change-out procedures. The assembly of components constituting separator lining 23 is specifically designed with this purpose in mind. The assembly or change-out procedures contemplated in the design of this invention allows quick and easy removal and replacement of liner segments 21 and sidewall liners 22, using rudimentary hand tools (such as a crescent wrench, ratchet wrench, and/or pry-bar), in limited working space, as is often the case in field change-out situations.

Referring to FIGS. 9, 10, 11, and 12, the ease of installation and change-out procedures embodied in the design of the invention is achieved by the following simple disassembly steps:

(1) To remove the sidewall liners 22, unfasten fasteners 24, and then simply lift out each piece of the two-piece sidewall liners 22.

(2) To remove the plurality of liner segments 21, unfasten the corresponding fasteners 26 and then simply lift out each liner segment 21, each liner segment 21 having a cleat 20 attached along one edge.

(3) The components can be inspected on site, and those not requiring replacement can be reinstalled along with the replacement components.

This invention is designed to allow the various component parts of magnetic drum separator 11, and especially the various surface components of separator lining 23 to be simply, easily, and quickly removed and replaced whether due to abrasion, wear, or damage in the field, on site, and even in difficult, constrained and especially inaccessible settings with only a few rudimentary hand tools. These advantages in the design of the magnetic separation system according to the invention are not demonstrated in the prior art, and provide the grinding mill operator with a convenient and cost-effective labour-saving and time-saving method to remove and replace worn or damaged parts in both unanticipated breakdown or shutdown situations, as well as routine planned change-out situations.

The replacement of the various components of separator liner 23 is essentially the reversal of the disassembly procedures:

(1) Each liner segment 21 is fitted onto magnetic drum 16 as illustrated in FIGS. 10 and 11. Care must be taken to ensure the liner segments 21 are installed in the correct orientation, which is with the cleat joint edge 20*a* being on the leading edge of each cleat 20 in the same direction 27 as magnetic drum 16 rotates, thereby better protecting cleat joint edge 20*a* from discharge slurry 12. Referring to FIGS. 1, 2, and 10, discharge slurry 12 flows in direction 13, which results in it discharging from feed chute 1 onto outer drum surface 11*a* as magnetic drum 16 rotates in a direction 27 that is the same as direction 13. Having joint edge 20*a* on the leading edge of cleats 20 as magnetic drum rotates in direction 27 minimizes the abrasion or wear exposure to each cleat joint edge 20*a*.

(2) Once the plurality of liner segments 21 is installed in place, sidewall liners 22 are fitted into place over end plates 25. The relative softness and pliable nature of the polyurethane sidewall liners 22 and the polyurethane liner segments 21 allow all surface segments to be easily fitted together to form the tightly sealed joints of separator lining 23.

(3) Referring to FIG. 9, in order to firmly secure the fitted surface segments, fasteners 24 secure sidewall liners 22 in place. Then the ends of cleats 20 are fitted into corresponding recesses 22*b*, and fasteners 26 are tightened. This step seals the overlapping and interlocking joints in separator lining 23. Where desirable, a polyurethane bonding agent can be easily applied on site installations, to increase the bonding and sealing capacity of the joints.

(4) The process of fastening sidewall liners 22 and the ends of cleats 20 into corresponding recesses 22*b* with fasteners 26 eliminates any gap and improves the seal between outer drum liner 15*a* and sidewall liners 22.

Operation of Magnetic Separation System

Feed chute 1 and magnetic drum separator 11 interact so as to provide an improved system for magnetically separating ferrous material 17 from discharge slurry 12. Referring to FIGS. 1 and 2, as discharge slurry 12 exits the grinding mill (not shown) through discharge outlet 9, the rate of flow of discharge slurry 12 can vary greatly with production variables such as: (a) the speed of rotation of the grinding mill; (b) the rate of throughput of ore; (c) the volume capacity of the grinding mill's interior, which varies as a function of the amount of grinding media introduced and removed as well as the degree of wear of the grinding mill liner; (d) the volume of water introduced to create the slurry; and (e) the coarse grade mesh of the mill trunnion discharge cover screen (not shown) located at discharge outlet 9. The variability of the flow of discharge slurry 12 over the production cycle of the grinding mill is an important factor for determining the optimal design of an efficient magnetic drum separator system. Referring to FIGS. 1 and 2, at least the following three objectives are addressed by the present invention in achieving optimal efficiency in transferring discharge slurry 12 to the exposed outer drum surface 11*a* of magnetic drum separator 11:

(1) the system will cause ferrous material 17 to tend to settle to chute floor 4, resulting in closer proximity to magnetic drum separator 11 and thereby enhancing the ability of magnetic drum separator 11 to attract ferrous material 17 to wear surface 8*b* of adjustable flow plate 4*c*, and in turn to outer drum surface 11*a* of magnetic drum separator 11;

(2) the system ensures an even distribution of discharge slurry 12 over outer drum surface 11*a* of magnetic drum separator 11; and (3) the system allows discharge slurry 12 to contact outer drum surface 11*a* of magnetic drum separator 11 at the optimal point of contact, and remains there, so as to achieve maximum magnetic attraction and adhesion of ferrous material 17 to outer drum surface 11*a* of magnetic drum separator 11.

In FIG. 1, discharge slurry 12 is discharged from the grinding mill (not shown) through discharge outlet 9 into feed chute 1, and flows in direction 13 by reason of the combination of the discharge flow pressure generated by the milling process, and the mild (2% to 3%) downward slope of chute floor 4. The effect of gravity and the flow of discharge slurry 12 down feed chute 1 has the natural effect of helping ferrous material 17 settle to feed chute floor 4 and distributing discharge slurry 12 relatively evenly over the entire surface of chute floor 4 as discharge slurry 12 is contained between chute walls 2. Damper curtains 31 also assist in guiding discharge slurry 12 downward toward chute floor 4. This in turn contributes to a relatively even distribution of discharge slurry 12 flowing from leading edge 10 of feed chute 1 to outer drum surface 11*a* of magnetic drum separator 11, although, in the absence of any movement of adjustable flow plate 4*c*, the precise point on outer drum surface 11*a* at which falling discharge slurry 12 initially contacts magnetic drum separator 11 may still vary depending on the velocity and volume of the flow of discharge slurry 12 as it leaves leading edge 10.

In particular, referring to FIGS. 1 and 8, significant variability in flow rate and volume of discharge slurry 12 causes discharge slurry 12 to leave leading edge 10 of feed chute 1 at varying rates and volumes, and in turn, causes corresponding variations as to where discharge slurry 12 first contacts outer drum surface 11*a* of magnetic drum separator 11 since this is an open system having no cover or other enclosure, and no "feed introducer" extending from feed chute 1 into engagement with outer drum surface 11*a*, to force discharge slurry 12 against outer drum surface 11*a* by deflection or other physical means. Therefore, if discharge slurry 12 leaves leading edge 10 at a low velocity or volume, the initial magnetic contact area 11*b* will likely tend to be in a higher portion of outer drum surface 11*a*. However, if discharge slurry 12 leaves leading edge 10 at a high velocity or volume, initial magnetic contact area 11*b* will likely tend to be in the middle portion of outer drum surface 11*a* or will not contact outer drum surface 11*a* at all. The fact that variations in rate and volume of flow of discharge slurry 12 results in corresponding variations in initial magnetic contact area 11*b* creates a challenge in that the optimum level of magnetic separation efficiency achieved from magnetic drum separator 11 cannot be maintained as long as these flow variations occur, without concurrently adjusting initial magnetic contact area 11*b*.

This invention overcomes that problem by allowing initial magnetic contact area 11*b* to be varied in response to variations in the volume and flow of discharge slurry 12 so as to continually ensure initial magnetic contact area 11*b* of discharge slurry 12 achieves the maximum magnetic attraction and adhesion of ferrous material 17. Referring to FIG. 8, a magnetic separation system according to this invention allows initial magnetic contact area 11*b* to be adjusted to always coincide with an optimal initial contact area 11*c* simply by adjusting the extension of adjustable flow plate 4*c* to compensate for variations in the volume and flow of discharge slurry 12. As can be seen from FIGS. 1 and 8, changing the length of extension of adjustable flow plate 4*c* in turn will tend to change the position of initial magnetic contact area 11*b*. If discharge slurry 12 is flowing at a relatively high volume or velocity, causing discharge slurry 12 to contact outer drum surface 11*a* at an initial magnetic contact area 11*b* that is beyond optimal initial contact area 11*c*, then adjustable flow plate 4*c* can simply be retracted inward into recessed area 6*a* until initial magnetic contact area 11*b* once again coincides with optimal initial contact area 11*c*. On the other hand, if discharge slurry 12 is flowing at a relatively low volume or velocity, causing discharge slurry 12 to contact outer drum surface 11*a* at an initial magnetic contact area 11*b* that is short of optimal initial contact area 11*c*, then adjustable flow plate 4*c* can simply be extended outward from recessed area 6*a* until initial magnetic contact area 11*b* once again coincides with optimal initial contact area 11*c*.

Referring to FIGS. 1 and 8, a magnetic separation system according to the present invention preferably utilizes the following two-phase magnetic separation process, both phases affected by adjustments in adjustable flow plate 4*c*:

(1) in the first phase, a field of magnetic attraction 18 emanates from magnetic drum 16 over adjustable flow plate 4*c* to create an adjustable area of "primary" magnetic attraction within feed chute 1, so that the magnetic separation process commences even before discharge slurry 12 leaves feed chute 1 and comes into contact outer drum surface 11*a*; and (2) in the second phase, the same radial field of magnetic attraction 18 creates an adjustable area of "secondary" magnetic attraction on outer drum surface 11*a* between adjustable initial magnetic contact area 11*b* and a discharge point 32 where ferrous material 17 leaves magnetic drum 16 and falls into a discharge chute 33.

Both the "primary" and "secondary" areas of magnetic attraction are adjustable because both are affected by adjustments in adjustable flow plate 4*c*. The field of magnetic attraction 18 operating over the upper surface area of adjustable flow plate 4*c* between points 18*a* and 18*b* in FIG. 8, causes ferrous material 17 to be magnetically attracted to the upper surface of adjustable flow plate 4*c*, while the non-ferrous ore slurry 34 continues to flow at the same rate as discharge slurry 12 did immediately prior to reaching the adjustable area of primary magnetic attraction between points 18*a* and 18*b*. The difference in the inertia of non-ferrous ore slurry 34 and the magnetically-attracted ferrous material 17 further promotes the separation process between the materials.

The adjustable area of primary magnetic attraction between points 18*b* and 18*a* therefore simultaneously attracts and slows down the rate of flow of ferrous material 17, thereby assisting with the separation process as discharge slurry 12 and ferrous material 17 reach the adjustable area of secondary magnetic attraction between points 19*b* and 19*a* on outer drum surface 11*a*. Adjustable flow plate 4*c* is positioned to achieve the maximum magnetic attraction and adhesion between ferrous material 17 and outer drum surface 11*a*, and to maintain the optimal area of initial magnetic contact 11*c* shown in FIG. 8. The primary magnetic attraction stage is functionally dependent on the secondary magnetic separation stage since adjustable flow plate 4*c* simultaneously controls both the adjustable area of primary magnetic attraction between points 18*a* and 18*b*, as well as the initial magnetic contact area 11*b* for discharge slurry 12 on outer drum surface 11*a* in the adjustable area of secondary magnetic attraction between points 19*a* to 19*b*.

The method employed by the invention whereby the primary magnetic attraction phase and the secondary separation phase are adjusted to maintain the optimal initial contact area 11*c*, as the rate or volume of the flow of discharge slurry 12 varies over the grinding mill production cycle, is as follows:

(1) As the flow of discharge slurry 12 decreases, so does the velocity of discharge slurry 12 leaving feed chute 1. Adjustable flow plate 4*c* is extended outward to reduce the volume of discharge slurry 12 on outer drum surface 11*a*, therefore reducing unnecessary wear on outer drum liner 15*a*. At the same time, extending adjustable flow plate 4*c* increases the adjustable area of primary magnetic attraction between points 18*b* and 18*a* in FIG. 8 up to a range approaching the full 25 degrees, and therefore more magnetic separation can take place over adjustable flow plate 4*c* during this first phase before discharge slurry 12 even leaves feed chute 1. Further, by adjusting adjustable flow plate 4*c*, ferrous material 17 can be optimally positioned to be fed onto outer drum surface 11*a* at the optimal initial contact area 11*c* and maintained there to improve the second phase of magnetic separation.

(2) Where there is an increasingly large volume or high rate of flow of discharge slurry 12, adjustable flow plate 4*c* is retracted inward, thus allowing the larger volume or higher velocity of discharge slurry 12 to be more extensively exposed to outer drum surface 11*a*, therefore greatly increasing the extent of magnetic attraction and adhesion operating on discharge slurry 12 as the adjustable area of secondary magnetic attraction between points 19*b* and 19*a* in FIG. 8 is increased from 215 degrees to approach the full 240 degrees along outer drum surface 11*a*.

(3) Effective and efficient extraction and separation of ferrous material 17 from discharge slurry 12 is accomplished by utilizing feed chute 1 as explained above. Adjustable flow plate 4*c*, the primary magnetic separation process, and the secondary magnetic separation process according to this invention achieve the objectives mentioned above as being desirable for magnetic separation by:

(a) evenly distributing discharge slurry 12 over chute floor 4, and over outer drum surface 11*a;*

(b) slowing down the velocity of ferrous material 17 by attracting it to wear surface 8*b* of adjustable flow plate 4*c*, while allowing non-ferrous ore slurry 34 to continue to flow at the same velocity as discharge slurry 12 did prior to reaching the adjustable area of primary magnetic attraction between points 18*b* and 18*a* in FIG. 8, thus effecting a primary magnetic separation process even before discharge slurry 12 ever contacts magnetic drum 16, and all without a physical velocity break for discharge slurry 12 since it is preferable for non-ferrous ore slurry 34 to continue at the same velocity while only ferrous material 17 slows down;

(c) completing the separation of ferrous material 17 from non-ferrous ore slurry 34 through the secondary separation process where ferrous material 17 is attracted and adhered to the more powerful magnetic force exerted by direct contact between ferrous material 17 and outer drum surface 11*a* in the adjustable area of secondary magnetic attraction between points 19*b* and 19*a;*

(d) causing all ferrous material 17 to be exposed to a large area of magnetic force, which ensures that ferrous material 17 will be separated from non-ferrous ore slurry 34;

(e) referring to FIG. 1, allowing non-ferrous ore slurry 34 to continue forward through gravity and momentum in the direction 13 of discharge slurry 12 as it is discharged from leading edge 10 of adjustable flow plate 4*c*, the forward inertia of non-ferrous ore slurry 34 not being affected by the magnetic force operating on ferrous material 17, such that non-ferrous ore slurry 34 will fall into a catchment area (not shown) free of ferrous material 17 and ready for further processing in the mill cycle;

(f) referring to FIG. 1, using a spray applicator 35 to spray ferrous material 17 with water, preferably while ferrous material 17 is still rotating through the adjustable area of secondary magnetic attraction between points 19*b* and 19*a;* and (g) continuing to rotate magnetic drum 16 so that ferrous material 17 retained on outer drum surface 11*a* by the radial field of magnetic attraction 18 and by cleats 20 rotates through the adjustable area of secondary magnetic attraction between points 19*b* and 19*a* until the radial field of magnetic attraction 18 ends at discharge point 32, whereupon gravity operates to cause ferrous material 17 to fall into discharge chute 33.

(iv) The invention achieves the combined objectives of maximizing the efficient separation of ferrous material 17 from discharge slurry 12, while minimizing the costs of wear and tear on the invention apparatus through the separation process. This is achieved by adjusting the exposure of outer drum surface 11*a* to the highly abrasive discharge slurry 12 in order to minimize the wear and abrasion caused by the significant variations in the volume and rate of flow of discharge slurry 12 during the production cycle of the grinding mill. The invention exposes only outer drum liner 15*a* to the full flow of the abrasive discharge slurry 12 when the rate and volume of flow is at the highest levels, and thereby necessitates the maximum level of magnetic force to be exerted by magnetic drum separator 11, which is achieved by exposing ferrous material 17 to the maximum surface area of outer drum liner 15*a*. At other periods in the grinding mill production cycle when the rate and volume of flow is less, then less magnetic force is required for the separation process, and less exposure of outer drum surface 11*a* to the abrasive discharge slurry 12 is necessary.

(v) The invention design achieves efficient separation over the life of the grinding mill production cycle by adjusting to significant variations in the volume and rate of flow of discharge slurry 12, while also promoting conservation of its wear surfaces and extension of its production life cycle by minimizing exposure of outer drum surface 11*a* to the highly abrasive effects of discharge slurry 12.

Further, the present invention overcomes many of the costly and inconvenient design characteristics of the prior art, including the following:

(1) The invention eliminates the enclosed feed box, and instead uses an open trunnion discharge feed chute 1 from discharge outlet 9 to leading edge 10 of an adjustable flow plate 4*c*.

(2) As the entire separation process of the invention is designed in an open feed chute layout, it is very accessible for repair, replacement, and change-out.

(3) To further facilitate repair, replacement, and change-out, the wear surfaces have all been designed for quick change-out. This is achieved by using magnetic wear plate retainer 7 to fasten floor wear plate 4*b*, as well as the quick change-out design of adjustable flow plate 4*c* and the various surface components of lining 23.

(4) Adjustable flow plate 4*c* eliminates the need for:
(a) an overflow capacity area in the feed box;
(b) an abrasion-susceptible velocity break; or
(c) a stationary cover for forcing all of discharge slurry 12 against the outer drum surface of outer drum surface 11*a*, as per U.S. Pat. No. 6,149,014 (which is susceptible to heavy abrasion and possibly head pressure build-up).

(5) The invention is more compact than the prior art in size and potentially more adaptable to constrained space applications often prevalent in existing grinding mill industry plant sites.

(6) There is much less risk of damage, wear, and abrasion in the present invention compared to prior art by the nature of the open trunnion discharge design of feed chute 1, since there is less of outer drum surface 11*a* necessarily in contact with the abrasive discharge slurry 12, and no risk of head pressure build-up.

(7) The present invention is very accessible for quick on-the-job repairs or removal and replacement of parts with minimal or no down time to the grinding mill production process.

(8) The invention is designed for the operator to adjust the magnetic drum separation process in response to variable flow of discharge slurry 12 volumes and/or velocity with a simple control command that extends or retracts adjustable flow plate 4*c* to attain the optimal initial contact area 11*c* of flow of discharge slurry 12 and the external surface of outer drum liner 15*a*. This in turn, maximizes the magnetic attraction and adhesion capability of magnetic drum separator 11 in separating ferrous material 17 from non-ferrous ore slurry 34.

Of course, an electronically-controlled adjuster (not shown) can be programmed to automatically adjust adjustable flow plate 4*c* based on input from a flow volume sensor (not shown) to avoid manual operator adjustment to maintain maximum separation efficiency.

Further, in light of the fact that the direction 27 in which magnetic drum 16 rotates is the same direction as the direction 13 in which discharge slurry 12 flows, a variable speed motor (not shown) can also be employed to vary the revolutions per minute (RPM) of magnetic drum 16 in response to variations in rate and volume of flow of discharge slurry 12 during the grinding mill production cycle. The effect of increasing the rate of RPM of magnetic drum 16 in direct relation to the increase in the rate and volume of flow of discharge slurry 12 is to reduce the wear and abrasion on outer drum liner 15*a*. This is due to the increased RPM in direct relation to the increased rate and volume of flow of discharge slurry 12, thereby reducing the resistance of magnetic drum separator 11 to the increased rate and volume of flow of discharge slurry 12 over outer drum surface 11*a*. The use of a variable speed motor, although very useful in reducing wear and abrasion in respect of the present invention, would not have been effective in a prior art enclosed magnetic drum separator; not only might a variable speed motor have had no ameliorating effect on abrasion-related wear or damage in an enclosed system, but it might even have increased the amount of abrasion-related wear, damage, and possible head pressure build-up, as increasing the RPM of the drum would increase the rate and volume of discharge slurry 12 forced through the enclosed system.

Although the general concept of using a magnetic drum separator 11 rotating about a fixed drum shaft 29 in the same direction 13 as the flow of discharge slurry 12, as a means of separating ferrous material 17 from discharge slurry 12, is well-known to those skilled in the art, the present invention goes far beyond the prior art. In addition to the very significant advances derived just from adjustable flow plate 4*c*, the invention has many other beneficial features, including the following:

(1) This invention preferably uses a unique design for overlapping and interlocking a plurality of replaceable, non-ferrous drum liner segments 21, each having a cleat 20 integrated therein along one edge and comprised of 80A durometer polyurethane (or some other similarly highly abrasion-resistant elastomeric material), that in combination forms a replaceable, abrasion-resistant outer drum liner 15*a*.

(2) This invention preferably uses non-ferrous abrasion-resistant elastomeric material for the plurality of surface segments forming the non-ferrous, abrasion-resistant, replaceable separator lining 23, simultaneously forming both a strong joint between the liner segments 21 and the sidewall liners 22, while at the same time being easily and quickly removable and replaceable.

(3) This invention preferably uses a non-ferrous, metal bar 28 within each cleat 20 to provide greater structural strength and support to both the liner segments 21 and the cleats 20, while at the same time, being utilized to create greater structured integrity and stability to the magnetic drum separator 11 as a whole.

(4) This invention preferably allows the design and integration of the liner segments 21 and sidewall liners 22 to be fastened to both of the end plates 25, while fastening them together as a complete unit using fasteners 26, which serves to allow the assembled magnetic drum separator 11 to have strength, stability, and structural integrity, while permitting it to be quickly and easily disassembled, thereby making on-site field repairs or change-outs quick, easy, and simple with only rudimentary hand tools.

(5) This invention preferably uses polyurethane wear surface components, which are quickly and easily removed and replaced, and which allow a minimum of down time with on-site replacement of some or all wear surface components, whether due to emergency on-site field repairs or during regular change-out.

(6) The use of replaceable polyurethane wear surface components further allows operators to replace only those components actually abraded, worn, or damaged and saves the expense of unnecessary replacement of wear surface components.

(7) Although U.S. Pat. No. 6,149,014 discloses its own method for separating non-ferrous ore slurry 34 from ferrous material 17, U.S. Pat. No. 6,149,014 teaches an enclosed system incorporating a partitioned product hopper having an externally adjustable splitter to partition metallic fragments from the bulk slurry flow. The present invention does not require a physical splitter, and simply uses a combination of magnetic force, inertia, and gravity to separate and direct the discharge of both non-ferrous ore slurry 34 and ferrous material 17 into the respective receptacles designed for each. This reduces wear and tear, and the likelihood of mechanical failure or malfunction.

(8) U.S. Pat. No. 6,149,014 teaches the use of a drum spray bar to clean the magnetic drum after both the bulk slurry and the ferrous material have already fallen off, in order to clean the drum surface for further use. In the present invention, spray applicator 35 is located to spray ferrous material 17 with water while ferrous material 17 is still in contact with outer drum surface 11*a*. This accomplishes the dual purpose of cleaning not only debris and residual discharge slurry 12 off of outer drum surface 11*a*, which enhances the magnetic attraction and retention capability of magnetic drum 16, but also cleaning ferrous material 17 as well. This advancement is valuable as ferrous material 17 is recyclable, and is worth more per ton if it can be delivered clean to the recycler. In the present invention, no separate cleaning step is required for ferrous material 17 after it leaves outer drum surface 11*a*.

(9) The novelty and inventiveness of the magnetic drum separator as disclosed in this invention is equally applicable to any other application calling for a magnetic separation system, and is not limited to its application in the present embodiment as a mill trunnion magnetic drum separator 11 used in concert with a mill trunnion discharge feed chute 1 to separate ferrous material from mill trunnion discharge slurry 12.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A magnetic separation system to remove ferrous material from a discharge slurry of an operating grinding mill comprising:

(a) a feed chute for receiving discharge slurry, said feed chute comprising walls and a feed chute floor having an adjustable feed chute floor portion for controlling the release of discharge slurry from said feed chute, and said feed chute further comprising an electronically-controlled adjuster programmed to automatically adjust said adjustable feed chute floor portion in response to changes in flow of discharge slurry; and (b) a magnetic drum separator comprising a drum rotatable about an axis below said feed chute, said drum having a generally cylindrical outer surface and having a fixed magnet assembly within said cylindrical outer surface, wherein adjustment of said adjustable chute floor portion controls where discharge slurry released from said feed chute will contact said outer surface of said drum.

2. A magnetic separation system as claimed in claim 1, wherein said fixed magnet assembly provides a radial field of magnetic attraction extending over at least half of the circumference of said drum.

3. A magnetic separation system as claimed in claim 2, wherein said fixed magnet assembly provides at least a 240-degree radial field of magnetic attraction about the circumference of said drum.

4. A magnetic separation system as claimed in claim 1, wherein said fixed magnet assembly provides a radial field of magnetic attraction extending over said adjustable feed chute floor portion when said adjustable feed chute floor portion is in its most extended position.

5. A magnetic separation system as claimed in claim 1, wherein said magnetic drum separator is covered by a replaceable protective lining.

6. A magnetic separation system as claimed in claim 5, wherein said lining is comprised of a non-ferrous elastomeric material.

7. A magnetic separation system as claimed in claim 1, wherein said magnetic drum separator further comprises an end plate at each end of said drum, and wherein said outer surface of said drum and said end plates together define an unenclosed passage for the flow of discharge slurry released from said feed chute.

8. A magnetic separation system as claimed in claim 1, further comprising a plurality of cleats affixed to said outer surface of said drum and extending longitudinally across said outer surface to assist the transfer of ferrous material.

9. A magnetic separation system as claimed in claim 8, wherein each cleat has therethrough a metallic bar.

10. A magnetic separation system as claimed in claim 1, wherein said drum is covered by a replaceable protective lining having a plurality of cleats extending therefrom longitudinally across said outer surface of said drum.

11. A magnetic separation system as claimed in claim 10, wherein each cleat has therethrough a metallic bar.

12. A magnetic separation system as claimed in claim 1, wherein said adjustable feed chute floor portion is non-ferrous.

13. A magnetic separation system as claimed in claim 1, wherein the top surface of said adjustable feed chute floor portion is a replaceable, abrasion-resistant wear plate.

14. A magnetic separation system as claimed in claim 1, wherein said feed chute further comprises a rubber damper curtain suspended above said feed chute floor.

15. A magnetic separation system as claimed in claim 1, further comprising a variable speed motor for adjusting the speed of rotation of said drum in response to variations in flow of discharge slurry.

16. A magnetic separation system to remove ferrous material from a discharge slurry of an operating grinding mill comprising:

(a) a feed chute for receiving discharge slurry, said feed chute comprising walls and a feed chute floor having an adjustable feed chute floor portion for continuing the release of discharge slurry from said feed chute; and (b) a magnetic drum separator comprising a drum rotatable about an axis below said feed chute, said drum having a generally cylindrical outer surface and having a fixed magnet assembly within said cylindrical outer surface, wherein adjustment of said adjustable chute floor portion controls where discharge slurry released from said feed chute will contact said outer surface of said drum, and wherein said drum is covered by a replaceable protective lining having a plurality of cleats extending therefrom longitudinally across said outer surface of said drum, and wherein said lining consists of a plurality of liner segments each having a cleat Integrated therein along one longitudinal edge thereof, which liner segments together overlap and interlock on said drum to form said lining, with each of said cleats forming a seal over the joint between adjacent liner segments.

17. A magnetic separation system as claimed in claim 16, wherein each cleat has therethrough a metallic bar.

18. A magnetic separation system as claimed in claim 16, wherein said liner segments are comprised of a non-ferrous elastomeric material.

19. A magnetic separation system as claimed in claim 16, wherein said magnetic drum separator further comprises an end plate at each end of said drum, and wherein each end plate is covered with a replaceable protective sidewall liner, said sidewall liner comprising segments each having a keyed edge for an interlocking fit with a corresponding recess at the end of one of said liner segments, and wherein said liner segments and said sidewall liners together form a replaceable protective lining for the entire magnetic drum separator.

20. A magnetic separation system as claimed in claim 19, wherein said liner segments and said sidewall liners are comprised of a non-ferrous elastomeric material.

21. A magnetic separation system as claimed in claim 1, wherein said feed chute is an open, trunnion discharge feed chute.

22. A magnetic separation system as claimed in claim 1, wherein said feed chute floor has a downward slope of 2% to 3% for discharge slurry to flow down before being released from said feed chute.

23. A magnetic separation system as claimed in claim 22, wherein the top surface of a portion of said feed chute floor comprises a replaceable, abrasion-resistant wear plate.

24. A magnetic separation system as claimed in claim 23, wherein said wear plate is ferrous.

25. A magnetic separation system as claimed in claim 24, wherein said wear plate is secured in place within said feed chute using a magnetic retainer.

26. A feed chute for receiving discharge slurry for controlled release onto a magnetic drum separator, said feed chute comprising walls and a feed chute floor having an adjustable feed chute floor portion, and said feed chute further comprising an electronically-controlled adjuster, programmed to automatically adjust said adjustable feed chute floor portion in response to variations in flow of discharge slurry, wherein adjustment of said adjustable chute floor portion controls where discharge slurry released from said feed chute will contact said magnetic drum separator.

27. A feed chute as claimed in claim 26, wherein said feed chute floor has a downward slope of 2% to 3% for discharge slurry to flow down before being released from said feed chute.

28. A feed chute as claimed in claim 26, wherein the top surface of said feed chute floor comprises a replaceable, abrasion-resistant wear plate.

29. A feed chute as claimed in claim 28, wherein said wear plate is ferrous.

30. A feed chute as claimed in claim 29, wherein said wear plate is secured in place within said feed chute using a magnetic retainer.

31. A feed chute as claimed in claim 26, wherein said adjustable feed chute floor portion is non-ferrous.

32. A feed chute as claimed in claim 26, wherein the top of said adjustable feed chute floor portion is a replaceable, abrasion-resistant wear plate.

33. A feed chute as claimed in claim 26, wherein said feed chute further comprises a rubber damper curtain for further controlling the flow of discharge slurry.

34. A method of removing ferrous material from a discharge slurry flow comprising:

(a) discharging discharge slurry into a feed chute, said feed chute comprising a feed chute floor having an adjustable feed chute floor portion;

(b) releasing said discharge slurry from said feed chute onto the outer surface of a rotating drum, said drum having a fixed magnet assembly within said outer surface for providing a radial field of magnetic attraction extending over a portion of the circumference of said drum;

(c) rotating said outer surface of said drum in the direction of the flow of said discharge slurry;

(d) adjusting said adjustable feed chute floor portion so as to maintain, at a predetermined point, the area at which discharge slurry released from said feed chute contacts said outer surface of said drum, wherein said adjustment step comprises using an electronically-controlled adjuster programmed to automatically adjust said adjustable feed chute floor portion in response to variations in flow of diacharge slurry;

(e) separating ferrous material from said discharge slurry by magnetically attracting ferrous material to said drum while allowing non-ferrous discharge slurry to flow past and off said drum; and (f) conveying ferrous material away from said non-ferrous discharge slurry and then discharging said ferrous material from said drum.

35. A method as claimed in claim 34, wherein said fixed magnet assembly provides at least a 240-degree radial field of magnetic attraction about the circumference of said drum.

36. A method as claimed in claim 34, wherein said fixed magnet assembly provides a radial field of magnetic attraction extending over said adjustable feed chute floor portion when adjustable feed chute floor portion is in its most extended position.

37. A method as claimed in claim 36, further comprising, in respect of discharge slurry as it flows through said feed chute, magnetically attracting ferrous material from said discharge slurry downward toward said adjustable feed chute floor portion.

38. A method as claimed in claim 34, further comprising spraying said ferrous material with water at an area on said outer surface of said drum where said ferrous material is still magnetically attracted to said drum.

39. A method as claimed in claim 34, further comprising covering said magnetic drum with a replaceable protective lining.

40. A method as claimed in claim 39, wherein said protective lining comprises a plurality of liner segments that overlap and interlock with one another for a sealing fit.

41. A method as claimed in claim 34, wherein said feed chute is an open, trunnion discharge feed chute.

42. A method as claimed in claim 34, wherein discharge slurry flows down a slope of 2% to 3% over said feed chute floor before being released from said feed chute.

43. A method of removing ferrous material from a discharge slurry flow comprising:

(a) discharging discharge slurry into a feed chute, said feed chute comprising a feed chute floor having an adjustable feed chute floor portion;

(b) releasing said discharge slurry from said feed chute onto the outer surface of a rotating drum, said drum having a fixed magnet assembly within said outer surface for providing a radial field of magnetic attraction extending over a portion of the circumference of said drum;

(c) rotating said outer surface of said drum in the direction of the flow of said discharge slurry, wherein said rotation step comprises using a variable speed motor for adjusting the speed of rotation of said outer surface of said drum in response to variations in flow of discharge slurry;

(d) adjusting said adjustable feed chute floor portion so as to maintain, at a predetermined point, the area at which discharge slurry released from said feed chute contacts said outer surface of said drum;

(e) separating ferrous material from said discharge slurry by magnetically attracting ferrous material to said drum while allowing non-ferrous discharge slurry to flow past and off said drum: and (f) conveying ferrous material away from said non-ferrous discharge slurry and then discharging said ferrous material from said drum.

* * * * *